US006622602B2

(12) United States Patent
Rompa

(10) Patent No.: US 6,622,602 B2
(45) Date of Patent: Sep. 23, 2003

(54) DEVICE FOR SLICING LOAVES AND OTHER BAKERY PRODUCTS

(75) Inventor: Jozef J. Th. Rompa, Oosterhout (NL)

(73) Assignee: Rompa Patent Beheer B.V., Oosterhout (NL)

( * ) Notice: Subject to any disclaimer, the term of this patent is extended or adjusted under 35 U.S.C. 154(b) by 0 days.

(21) Appl. No.: 10/034,582

(22) Filed: Dec. 28, 2001

(65) Prior Publication Data

US 2002/0056352 A1 May 16, 2002

Related U.S. Application Data

(62) Division of application No. 09/396,082, filed on Sep. 14, 1999, now Pat. No. 6,431,041, which is a continuation of application No. PCT/NL98/00136, filed on Mar. 6, 1998.

(30) Foreign Application Priority Data

Mar. 14, 1997 (NL) ..... 1005537

(51) Int. Cl.[7] ..... B27B 3/10; B26D 7/08

(52) U.S. Cl. ..... 83/168; 83/932; 83/751; 83/758; 83/768; 83/786; 83/481; 83/487; 83/571; 83/581.1; 83/425.3; 83/954; 83/699.21; 83/827

(58) Field of Search ..... 83/167, 168, 751, 83/753, 754, 758, 759, 760, 768, 769, 771, 772, 775, 757, 781–784, 786, 481, 485, 487, 571, 426, 581.1, 624, 425.3, 625, 626, 628, 827, 932, 954, 427, 698.31, 699.21, 699.41

(56) References Cited

U.S. PATENT DOCUMENTS

| | | | | | |
|---|---|---|---|---|---|
| 1,407 | A | * | 12/1810 | Olds et al. | 83/786 |
| 264,473 | A | | 9/1882 | Nixon | |
| 1,778,007 | A | | 10/1930 | Criner | |
| 2,024,157 | A | * | 12/1935 | Fritz, Sr. | 83/751 |
| 2,033,700 | A | * | 3/1936 | Geiger | 83/751 |
| 2,034,250 | A | | 3/1936 | Rohwedder | |
| 2,095,620 | A | * | 10/1937 | Tuthill et al. | 83/751 |
| 2,160,387 | A | * | 5/1939 | Lyon | 83/61 |
| 2,315,761 | A | * | 4/1943 | Ahrndt | 83/144 |
| 2,820,492 | A | * | 1/1958 | Traben | 83/662 |
| 2,845,100 | A | * | 7/1958 | Jalosky | 83/751 |
| 3,807,266 | A | * | 4/1974 | Camp | 83/404.4 |
| 3,875,840 | A | | 4/1975 | Moorman | |
| 3,896,693 | A | * | 7/1975 | Johannsson | 83/748 |
| 4,619,166 | A | * | 10/1986 | Valavaara | 83/461 |
| 4,993,299 | A | | 2/1991 | Hallez et al. | |
| 5,768,970 | A | | 6/1998 | Wolf et al. | |
| 5,894,775 | A | | 4/1999 | Brash et al. | |
| 6,431,041 | B1 | * | 8/2002 | Rompa | 83/168 |

FOREIGN PATENT DOCUMENTS

| | | |
|---|---|---|
| DE | 29602579 U1 | 5/1996 |
| DE | 19537826 C1 | 2/1997 |
| EP | 0 040 545 | 11/1981 |
| EP | 0 047 372 | 3/1982 |
| FR | 841214 | 5/1939 |
| GB | 1 464 604 | 2/1977 |
| JP | 07251398 | 10/1995 |

* cited by examiner

*Primary Examiner*—Boyer D. Ashley
(74) *Attorney, Agent, or Firm*—Hoffmann & Baron, LLP

(57) ABSTRACT

A device (1) is provided for slicing loaves and similar bakery products. The device includes a stationary frame (2) including a support (4, 5) for supporting the loaves or bakery products. A blade carrier (10) holds a plurality of thin elongate cutting blades (11) at spaced locations with respect to one another. Each blade includes a cutting edge (13) for cutting the loaves or bakery products. The device includes a blade carrier drive (51–56, 65–68) which provides for first and second movement of the blade carrier. A cleaning mechanism (70, 71) is provided for cleaning the cutting blades.

7 Claims, 9 Drawing Sheets

DEVICE FOR SLICING LOAVES AND OTHER BAKERY PRODUCTS

CROSS-REFERENCE TO RELATED APPLICATIONS

This application is a divisional of U.S. Ser. No. 09/396,082, filed Sep. 14, 1999, now U.S. Pat. No. 6,431,041, which is a continuation of PCT/NL98/00136, filed Mar. 6, 1998, which claims priority to NL 1005537 filed Mar. 14, 1997, all of which are incorporated herein by reference.

FIELD OF THE INVENTION

The present invention relates to a device for slicing loaves and other bakery products, such as for example cakes and pastries. These bakery products may optionally be completely frozen, or frozen just on the outside, in particular in order to allow cutting of soft bakery products or of bakery products with a filling which is soft at room temperature, such as pies. In addition, the invention relates to a cutting-blade carrier for a device of this kind and to the cleaning of the cutting blades of a device of this kind.

BACKGROUND OF THE INVENTION

A known device for slicing loaves is described in GB-1,464,604. This device is provided with two cutting-blade carriers, which are disposed one behind the other, as seen in the passage direction of the loaves. The two cutting-blade carriers are each guided in a straight line, substantially perpendicular to the passage direction of the loaves, in the frame of the device and are moved in a reciprocating manner in opposite phases.

In generally known bread-cutting devices, the cutting-blade carriers are driven with a rectilinear, reciprocating movement, which has an amplitude of between 30 and 45 millimeters and a frequency of 700 to 800 reciprocating movements per minute. Another known device has only one cutting-blade carrier, which is driven with a rectilinear, reciprocating movement which has an amplitude of 3 millimeters and a frequency of approximately 3000 reciprocating movements per minute.

In practice, the known devices have proven unsatisfactory. Particularly if the bread was baked shortly before, it adheres to the cutting blades, with the result that it is desirable, not to say necessary, to regularly remove the bread material which adheres to the cutting blades during the cutting operation. This is because bread residues adhere to the cutting blades to an ever increasing extent as the cutting blades become dirtier.

For the purpose of cleaning the cutting blades, it is generally known in the case of the devices of the large-amplitude type to provide one or more scraper members, which are disposed outside the path through the cutting device for the loaves, the cutting blades being scraped clean on moving past a cutting member. In practice, the loaves to be cut are frequently so high, approximately 15–20 centimeters as seen in the longitudinal direction of the cutting blades, that the central part of the bread-cutting length of the cutting blades does not move past one of the scraper members in these known devices, and is therefore not cleaned. In the case of the known small-amplitude device, it is impossible to clean the cutting blades in this manner during cutting of the bread.

It is also known to apply a small quantity of an edible lubricant to the cutting blades during the cutting operation, particularly when cutting bread with a low fat content. The application of lubricant can also only take place outside the path of the loaves. Owing to the considerations outlined in the preceding paragraph, it is clear that in many cases the known devices do not allow satisfactory lubrication of the cutting blades.

A further drawback of the known devices is that the cutting operation entails an undesirably high loss of bread material, owing to the formation of crumbs. The crumbs are mainly formed as a result of the contact between the sides of the cutting blades and the bread, in particular at the location of the transitions between that edge of each cutting blade which is provided with cutting formations and the substantially flat sides of this cutting blade.

SUMMARY OF THE INVENTION

The object of the present invention is to eliminate the abovementioned problems. Furthermore, the invention aims to eliminate a considerable number of other drawbacks of the known devices. These drawbacks include the fact that the known cutting-blade carriers are expensive and that exchanging a cutting-blade carrier requires a maintenance person and takes up considerable time, during which time cutting cannot take place. The present invention also aims to provide measures which improve the cleaning of the cutting blades, so that the cutting blades last longer and fewer crumbs are formed.

According to a first aspect, the present invention provides a device for slicing loaves and other bakery products, comprising a frame, which is provided with support means for the loaves, which support means define a path for the loaves through the device, a cutting-blade carrier, which holds a plurality of thin, elongate cutting blades next to one another and at a distance from one another, each cutting blade having a cutting edge which has cutting formations for cutting the loaf, drive means for creating a reciprocating movement of the cutting blades with respect to the support means for the loaves, which reciprocating movement is parallel to the longitudinal direction of the cutting blades, characterized in that the drive means of the cutting-blade carrier provide a first movement, which is characterized by a first amplitude in the longitudinal direction of the cutting blades and a first frequency, and also provide a second movement, which is characterized by a second amplitude in the longitudinal direction of the cutting blades and a second frequency, the first amplitude being greater than the second amplitude and the first frequency being lower than the second frequency, and in that the drive means are designed to superimpose the first movement and the second movement to form a resultant movement, and in that the drive means drive the cutting blades with the resultant movement, which preamble is based on GB-1,464,604, which device is characterized by the above-described characterizing part of the description.

The characteristic part of the device provides for the movement of each cutting-blade carrier to be the resultant of the low-frequency first movement, which may also be an intermittently executed movement, having a large amplitude, on the one hand, and a high-frequency, preferably continuous, second movement having a small amplitude, on the other hand.

In one preferred embodiment, the cleaning means may comprise, for example, two cleaning devices, one below and one above the path for the loaves, in which case, for example, the position of the top cleaning device is adjustable with respect to the support means for the loaves, so that the position of the top cleaning device can be matched to the height of the loaves to be cut. In a variant, only one cleaning device may be provided, for example at a short distance below the path for the loaves. The invention provides for the cutting action of the cutting blades to be effected substantially by the second movement and for the first movement to serve primarily to allow the cutting blades to move past the cleaning means over their entire bread-cutting length.

In another preferred embodiment, the effect is achieved that the cutting blades not only move in a rectilinear, reciprocating manner in the longitudinal direction of the cutting blades, as in the case of known devices, but also each cutting blade executes small loop movements with a high frequency. This loop movement is very advantageous for the cutting action of the cutting blades when cutting bread and other bakery products. The loop movement is also advantageous if the sides of the cutting blades bear against scraper surfaces of a scraper member, because in this case a type of polishing effect is achieved.

The advantageous direction of the loop-like movement is an arc-like path from a top point situated furthest away from the support means towards a bottom point situated closest to the support means, with a first deviation with respect to the imaginary straight line between the top point and the bottom point, which first deviation is directed counter to the passage direction, and in which the loop-like movement also describes an arc-like path from the bottom point to the top point, with a second deviation with respect to the imaginary straight line between the bottom point and the top point, which second deviation is likewise directed counter to the passage direction, and in which the first deviation is greater than the second deviation, the loaf to be cut remaining in a stable position on the support means.

Values which are advantageous in practice include those in which the first amplitude lies in the order of magnitude of a few centimeters and the second amplitude lies in the order of magnitude of one or several millimeters, the magnitude of the first amplitude being dependent substantially on the height of the loaf to be cut and on the arrangement of any cleaning means for the cutting blades. The second amplitude is preferably small.

Values which are advantageous in practice include those in which the first frequency lies in the order of magnitude of one or more strokes per second and the second frequency lies in the order of magnitude of several tens of, preferably more than a hundred, strokes per second, and it should be noted that in principle the first movement does not have to be a continuous movement, but may also be a stepwise movement, since the cutting action is effected substantially by means of the second movement.

The position of the cutting formations according to another aspect of the present invention is considerably closer together, i.e., with a finer toothing, than that which is used in the case of the known devices. The distance between the cutting formations is preferably less than the second amplitude. Moreover, each of the cutting blades is preferably provided on the cutting edge with cutting formations situated at regular distances from one another, the distance between adjacent cutting formations lying between 0.5 and 4 millimeters.

In another preferred embodiment in which the drive means for the cutting-blade carrier comprise an intermediate carrier, which is disposed between the frame and the cutting-blade carrier, in which the intermediate carrier is held in the frame such that it can move in a reciprocating manner substantially parallel to the longitudinal direction of the cutting blades, and in which the intermediate carrier is designed to support the cutting blades such that they can move with respect to the intermediate carrier, the drive means comprising first drive means, which are disposed between the frame and the intermediate carrier for driving the intermediate carrier such that it moves with respect to the frame, and also second drive means, which are disposed between the intermediate carrier and the cutting blades so as to drive the cutting blades such that they move with respect to the intermediate carrier, the second drive means only have to drive the relatively lightweight cutting-blade carrier and associated holding means, without having to cover a long drive path.

The invention makes it possible for there to be only one single cutting-blade carrier present, instead of two, as in the known devices. This is possible because in the device according to the invention the bread is not dragged along by the cutting blades which move with a small amplitude and a high frequency and are preferably regularly cleaned during the cutting operation. However, a variant of the device according to the invention comprises two cutting-blade carriers which are disposed one behind the other in the passage direction of the loaves, in which case an advantageous embodiment provides for the two cutting-blade carriers each to be driven with an identical second movement, but in opposite phases, and for the two cutting-blade carriers to be driven by common first drive means providing the first movement.

According to a second aspect, the present invention provides a device for slicing loaves and other bakery products, comprising a frame, which is provided with support means for the loaves, which support means define a path for the loaves through the device, a cutting-blade carrier, which holds a plurality of thin, elongate cutting blades next to one another and at a distance from one another, each cutting blade having a cutting edge which has cutting formations for cutting the loaf, which cutting-blade carrier has a top attachment body which is common to the cutting blades and a bottom attachment body which is common to the cutting blades, one end of each cutting blade being connected to the bottom attachment body and the other end of each cutting blade being connected to the top attachment body, tensioning means being provided so as to effect and maintain an axial operational tension in each cutting blade during the cutting operation, drive means for creating a reciprocating movement of the cutting blades with respect to the support means for the loaves, which reciprocating movement is parallel to the longitudinal direction of the cutting blades, characterized in that the top attachment body and the bottom attachment body of the cutting-blade carrier are displaceable with respect to one another, in that the drive means are provided with top holding means for releasably holding the top attachment body of the cutting-blade carrier and with bottom holding means for releasably holding the bottom attachment body of the cutting-blade carrier, and in that the tensioning means are designed so as to change the distance between the top holding means and the bottom holding means, so that after the top and bottom attachment bodies have respectively been arranged in the top and bottom holding means the distance between the top and bottom holding means can be increased, bringing about the axial operational tensioning of the cutting blades. The known cutting-blade carriers, an example of which is described in GB-2,007,971, comprise a rectangular framework, in which the cutting blades are fixed under tensile stress. The cutting-blade carriers are of robust and strong design, in order to be able to withstand the total tensile stress in all the cutting blades. A usual tensile stress is approximately 500 N per cutting blade, so that in the case of 40 cutting blades the side bars of the framework each have to be able to withstand a compressive force of 10 kN. On the other hand, the cutting-blade carrier must be lightweight, in order to limit the acceleration and retardation forces occurring at the reciprocating-movement frequency which is required for the cutting action. In order to fulfill both demands, the known cutting-blade carriers are generally produced from expensive metal alloys, such as magnesium alloys.

The measures make possible a considerably more lightweight, and in particular a less expensive, design of the cutting-blade carrier. In the device, the cutting-blade carrier no longer serves to hold the cutting blades at the required operational tension, as has hitherto been the case, but merely as a temporary holder for the cutting blades. The cutting blades are tensioned after the cutting-blade carrier has been placed in the device, with the aid of tensioning means which form part of the cutting device. The cutting-blade carrier can therefore be designed as a lightweight and simple holder which holds the cutting blades in the desired position and can be handled as a single unit with the cutting blades held therein. As a result of this measure, it is economically possible to keep a stock of a plurality of cutting-blade carriers with cutting blades therein for a single cutting device, for example to keep a separate cutting-blade carrier, with a suitable distance between the cutting blades, for each type of bread to be cut.

The measure according to an additional embodiment includes one in which the top holding means and the bottom holding means each comprise an elongate holding member which extends transversely to the passage direction and is provided with a groove, extending in its longitudinal direction, with a slide-in opening at one end of the holding member in question, which groove is open on the side facing towards the other holding member, so that the attachment bodies of the cutting-blade carrier can be slid into the holding members, which makes it possible to slide the cutting-blade carrier into the device transversely to the passage direction of the loaves, with the result that one cutting-blade carrier can be replaced quickly and easily with another.

A cutting-blade carrier for a device for slicing loaves and other bakery products, comprising a top bar and a bottom bar which is substantially parallel thereto, the top bar and the bottom bar being designed for attaching between them a plurality of thin, elongate cutting blades which are positioned next to one another and at a distance from one another, the top bar and the bottom bar being connected to one another by means of spacer means so as to form a unit which can be handled as a single entity, characterized in that the spacer means allow the top bar and the bottom bar to move apart, so as to tension the cutting blades with an axial operating tension which is suitable for cutting the loaf. The cutting-blade carrier can be used to realize the device according to the present invention. The spacer means of the cutting-blade carrier may take many different forms, for example the form of connecting elements which are placed between the top and bottom attachment bodies and provide a low resistance to extension, for example made of plastic material. It would also be possible to provide for the spacer means to be attached in a releasable manner to the top and bottom attachment bodies and to be removed entirely after placing the cutting-blade carrier in the cutting device, if appropriate automatically using the device itself.

According to a third aspect, the present invention provides a device for slicing loaves and other bakery products, comprising a frame, which is provided with support means for the loaves, which support means define a path for the loaves through the device, a cutting-blade carrier, which holds a plurality of thin, elongate cutting blades next to one another and at a distance from one another, each cutting blade having a cutting edge which has cutting formations for cutting the loaf, drive means for creating a reciprocating movement of the cutting blades with respect to the support means for the loaves, which reciprocating movement is parallel to the longitudinal direction of the cutting blades, cleaning means for the cutting blades being provided, in order to clean the cutting blades during cutting of the loaves, which cleaning means are disposed outside the path for the loaves which is defined by the support means, the cleaning means comprising a scraper member, which extends transversely to the cutting blades and is provided with a plurality of slot openings, each for the passage of a cutting blade, the scraper member forming a scraper surface on either side of each cutting blade, which surface is intended to scrape along the adjacent side of the cutting blade, characterized in that displacement means are provided so as to displace the scraper member with respect to the cutting blades in a reciprocating manner substantially transversely to the cutting blades. In bread-cutting devices, it is known to use scraper members whose slot openings are at an angle to the longitudinal direction of the cutting blades, so that on one side of the cutting blade the top edge of the slot opening forms a scraper surface, and on the other side the bottom edge forms a scraper surface which is in contact with the cutting blade. Owing to the inevitable wear to the scraper member at the location of the scraper surfaces, the contact pressure between the scraper surfaces and the cutting blade will gradually decrease, and the cleaning action is reduced. The displacement means according to the present invention enable one or other scraper surface alternately to be pressed against the cutting blade with an adjustable larger force, even if the scraper surfaces have already been worn away to some extent. As a result, the cutting blade is cleaned very effectively and the scraper member can still be used even if wear has taken place.

According to a fourth aspect, the present invention provides a device for slicing loaves and other bakery products, comprising a frame, which is provided with support means for the loaves, which support means define a path for the loaves through the device, a cutting-blade carrier, which holds a plurality of thin, elongate cutting blades next to one another and at a distance from one another, each cutting blade having a cutting edge which has cutting formations for cutting the loaf, drive means for creating a reciprocating movement of the cutting blades with respect to the support means for the loaves, which reciprocating movement is parallel to the longitudinal direction of the cutting blades, cleaning means for the cutting blades being provided, in order to clean the cutting blades during cutting of the loaves, which cleaning means are disposed outside the path for the loaves which is defined by the support means, the cleaning means comprising a scraper member, which extends transversely to the cutting blades and is provided with a plurality of slot openings, each for the passage of a cutting blade, the scraper member forming a scraper surface on either side of each cutting blade, which surface is intended to scrape along the adjacent side of the cutting blade, characterized in that one or more channels are arranged in the scraper member, which channels have an outlet port at each of the slot openings in the scraper member, and in that air-supply means are provided for supplying compressed air to the channels, which prevents contaminants scraped off a cutting blade from collecting in the slot opening in the scraper member.

An embodiment of this aspect of the present invention, in which the air-supply means comprise a stationarily disposed air-injection member, which extends past the reciprocatingly moveable scraper member and is provided with a plurality of air-blowing outlets, and in which the scraper member is provided with an air-inlet port opposite each air-blowing outlet of the air-injection member, each air-inlet port adjoining an associated channel in the scraper member, which channel has an outlet port at a number of the slot openings in the scraper member, makes it possible to combine the advantages of the devices of the third and fourth aspects of the present invention with one another, with the result that very effective cleaning of the cutting blades is achieved.

According to a fifth aspect, the present invention provides a device for reducing time for exchanging blades. As has already been mentioned above, it is desirable to reduce the time required for exchanging a cutting-blade carrier. The measures according to this aspect of the present invention contribute to reducing this time. These measures are particularly advantageous in combination with the previously described devices.

According to a sixth aspect, the present invention provides a cutting-blade carrier. In the case of the known cutting-blade carriers, all the adjustable attachment members are arranged on the top bar and all the fixed attachment members are arranged on the bottom bar of the cutting-blade carrier. However, the adjustable attachment members take up a larger space than that which is required for the fixed attachment members. The alternate arrangement allows a minimal distance between the cutting blades.

According to a seventh aspect, the invention provides a device with a provision for the scraper members which are required for scraping a set of cutting blades to be exchanged at the same time as the cutting-blade carrier, all this taking place automatically. This is possible as a result of the scraper members, of which there are usually two per set of cutting blades, already being attached beforehand temporarily to the cutting-blade carrier, and as a result of providing the cutting device with a suitably designed mechanism which, after the cutting-blade carrier has been placed in the device, grips the scraper members, moves them to their desired position and then holds them fast. If appropriate, there may be provision for the mechanism to fix the scraper members back on the cutting-blade carrier before the cutting-blade carrier is removed, so that these scraper members are removed together with the cutting-blade carrier. This design is particularly advantageous in combination with the designs of the previous devices.

According to an eighth aspect, the invention provides a device with a design of slot openings in the scraper member prevents wear causing the scraper surfaces to wear down to recesses in the walls of the slot openings. In practice, this would make it impossible to clean a new set of cutting blades with the same scraper member, since the cutting blades also become slightly worn and therefore new cutting blades would not fit in the worn-out recesses. This measure is particularly advantageous in combination with a previous device, in which the cutting blades perform a small loop-like movement in their plane.

It will be clear that the above-described aspects of the invention are advantageous by comparison with the known devices both separately and in various combinations. For an explanation of the device, reference is now made to the following description based on the drawing, in which:

DETAILED DESCRIPTION OF THE PREFERRED EMBODIMENTS

Figures 1A, 1B, 1C, 1D:
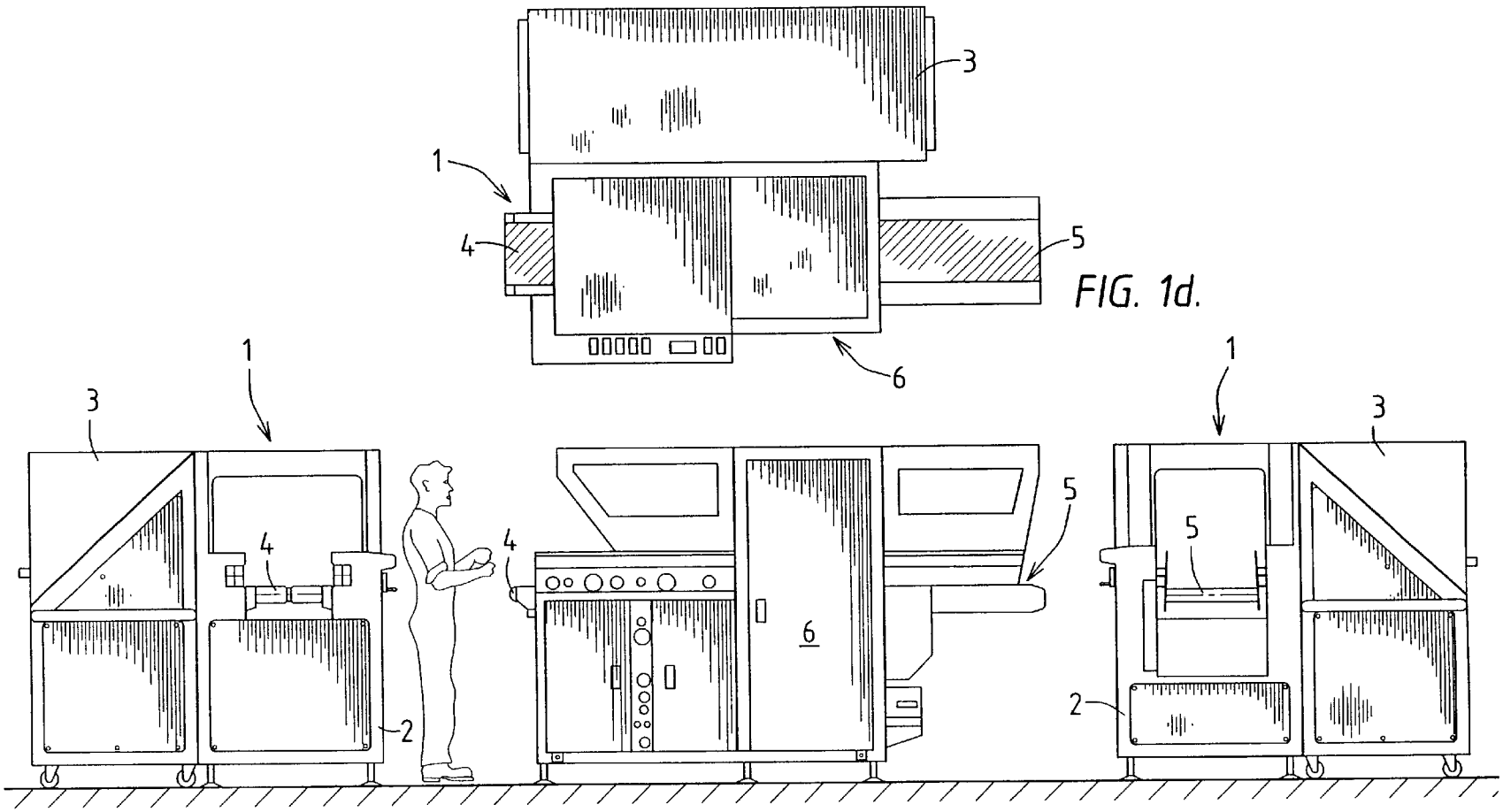
FIG. 1*a* shows a front view of an exemplary embodiment of the device according to the invention.
FIG. 1*b* shows the device in accordance with FIG. 1*a* as seen from the entry side for the loaves, FIG.
FIG. 1*c* shows the device in accordance with FIG. 1*a* as seen from the exit side for the loaves.
FIG. 1*d* shows the device in accordance with FIG. 1*a* in plan view, FIG. 2 diagrammatically shows a side view of an exemplary embodiment of the cutting-blade carrier and the drive means of the device according to the invention.

FIGS. 1*a*, 1*b*, 1*c*, 1*d* show the outside of an exemplary embodiment of the device according to the invention, with which device loaves and other bakery products can be sliced.

The device shown is intended in particular for industrial bakeries, where the device has to slice large numbers of loaves in continuous operation, which loaves have come out of the bakery oven shortly before being cut.

The device shown in fact comprises two parts, namely a device 1 for slicing loaves, which device 1 comprises a stationary frame 2 positioned on the ground, and furthermore a magazine and exchange device 3 which can be moved over the ground, and in which a stock of cutting-blade carriers for the cutting device 1 is accommodated. The magazine and exchange device 3 is placed against the rear side of the device 1 and will be explained with reference to FIG. 10.

The device 1 is provided with a feed device with a feed belt 4, on which the loaves 7 to be cut stand. In particular, there is provision for a conveyor system to be disposed upstream of the feed belt 4, which conveyor system supplies the loaves coming out of the bakery oven automatically and in an uninterrupted flow to the inlet side of the feed belt 4, the loaves bearing against one another at their sides. The feed belt 4 ends just upstream of a cutting-blade carrier, which is still to be described in more detail, with cutting blades (not shown in FIGS. 1*a*–1*d*), and on the other side of this carrier there extends a discharge device with a discharge belt 5 for discharging the cut loaves. The feed belt 4 and the discharge belt 5, together with guide plates 4*a* and 5*a* disposed in a fixed position close to the cutting blades, form a path for the loaves 7 through the device 1.

Figure 2:
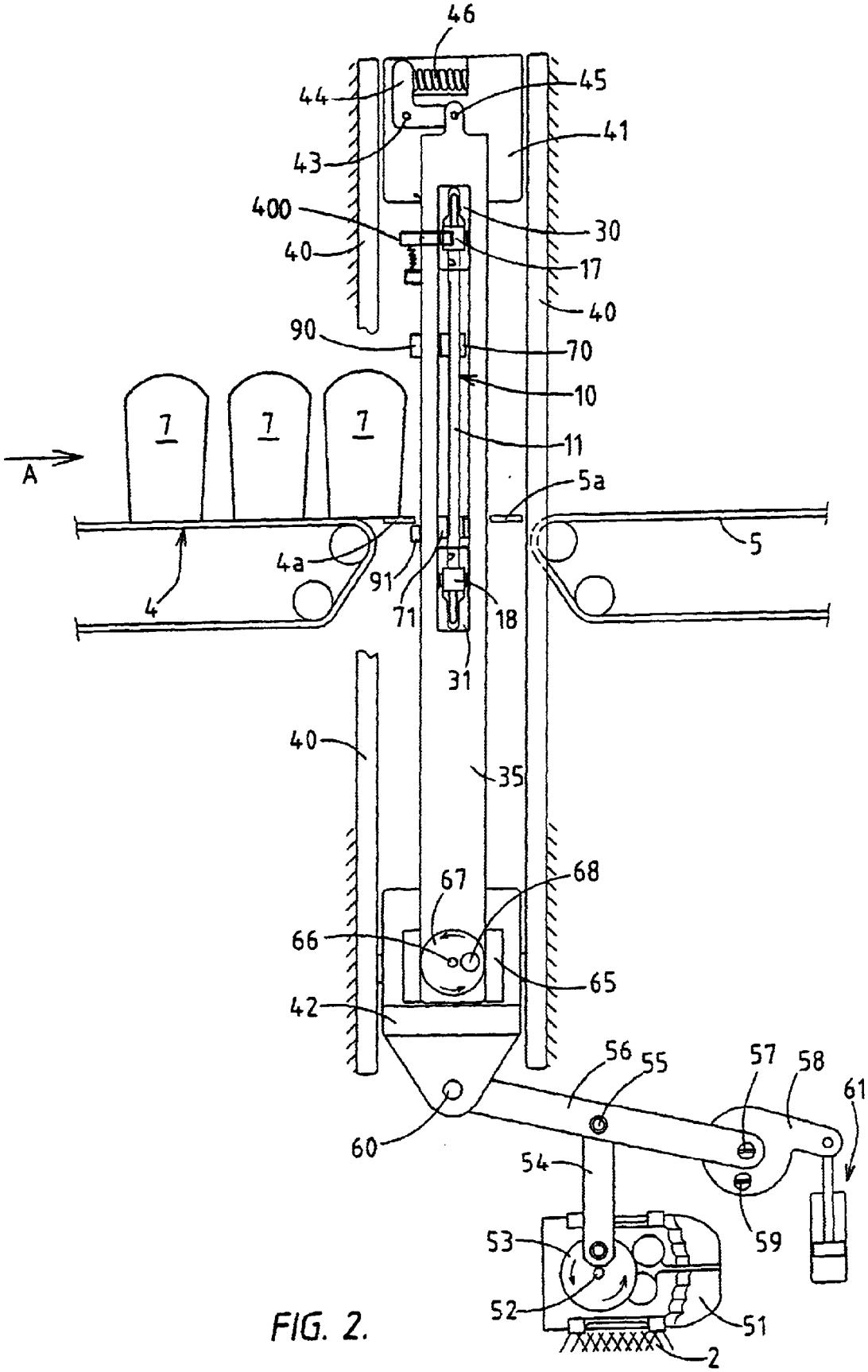

FIG. 2 diagrammatically illustrates that part of the device 1 which slices the loaves 7. The components shown in FIG. 2 are situated behind door 6 in FIG. 1*a*. FIG. 2 shows part of the feed belt 4, which in this figure is supporting three loaves 7 placed close together and is moving them forwards in the passage direction, arrow A. The figure also shows part of the discharge belt 5.

Figure 5:
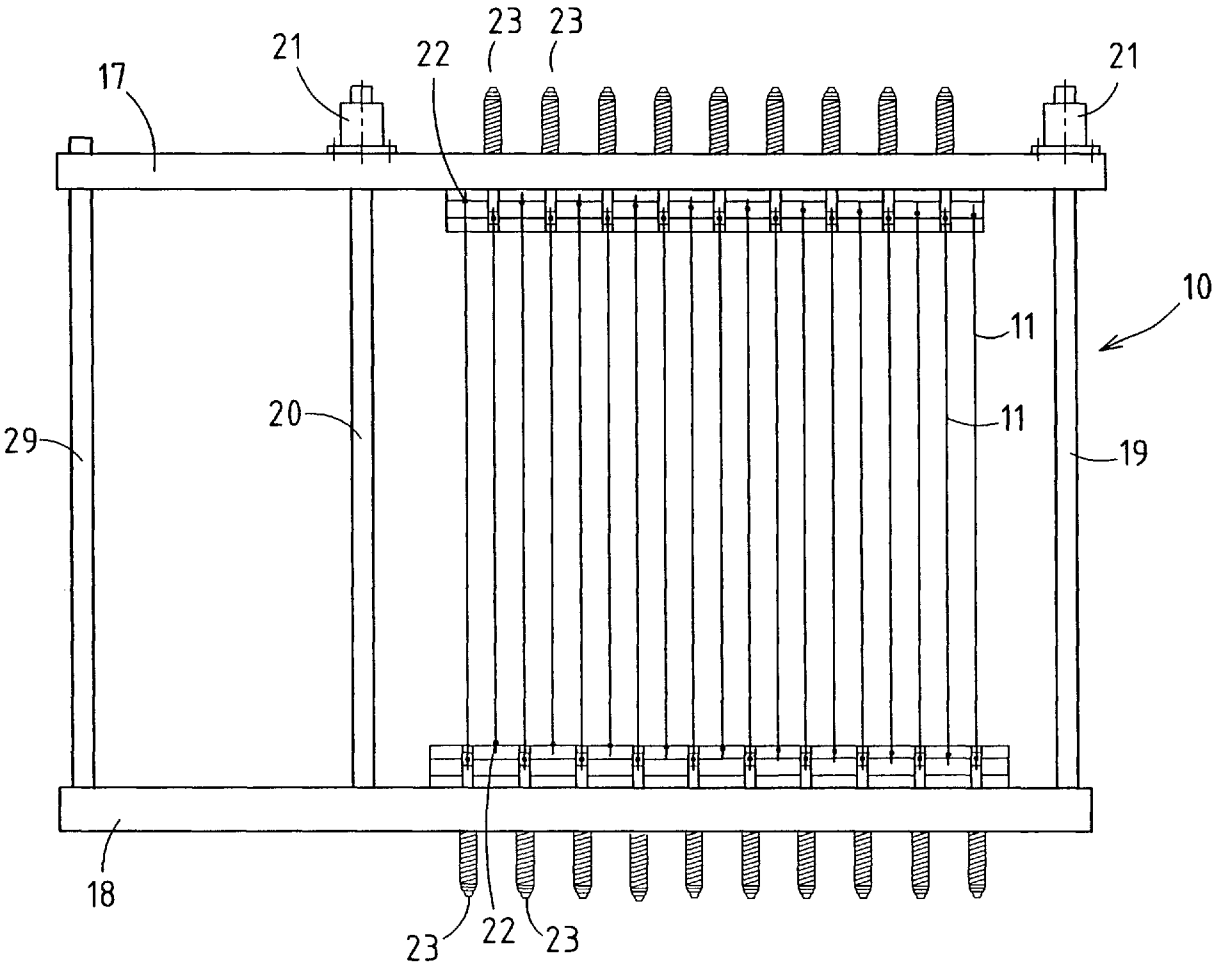
FIG. 5 shows a front view of the cutting-blade carrier in accordance with FIGS. 2, 3 and 4.
Figure 3:
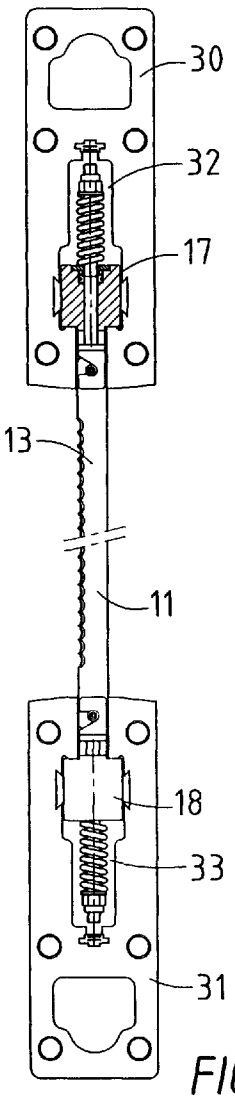
FIG. 3 shows the cutting-blade carrier in accordance with FIG. 2 and the top and bottom holding means for the cutting-blade carrier.
Figure 4:
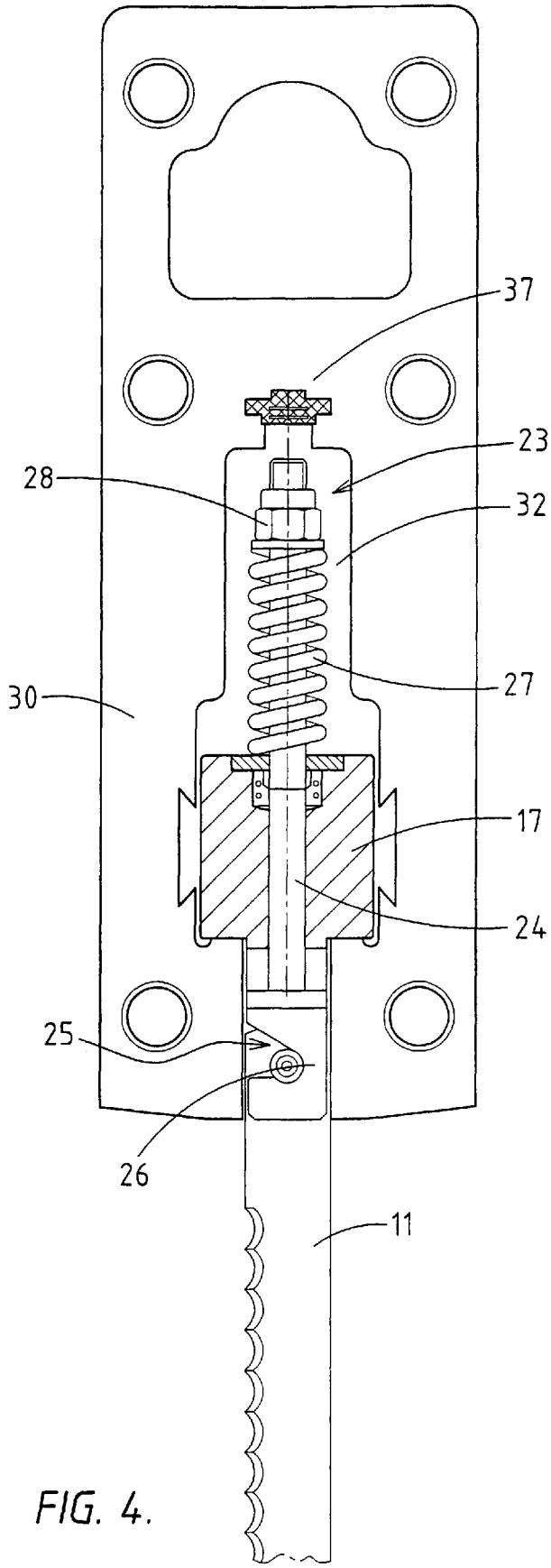
FIG. 4 shows the top part of the cutting-blade carrier and the top holding means of the device according to the invention, on an enlarged scale by comparison with FIGS. 2 and 3.
Figure 6:
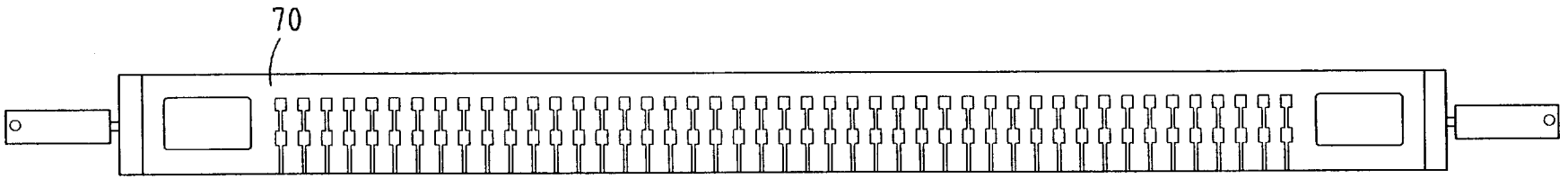
FIG. 6 shows a plan view of an exemplary embodiment of the scraper member according to the invention.

FIG. 2 shows the single cutting-blade carrier 10 of the device 1, which cutting-blade carrier 10 is shown more clearly in FIGS. 3, 4 and 5, and will now be explained with reference to these figures.

Figure 8:
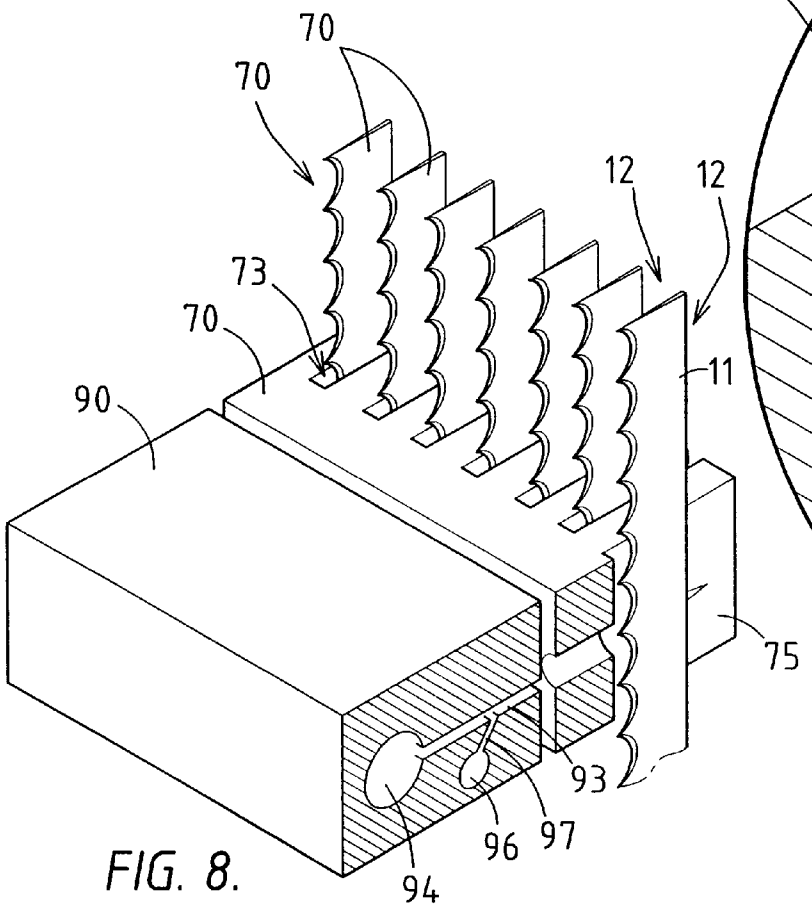
FIG. 8 shows a diagrammatic, perspective, sectional view of an exemplary embodiment of the cleaning means for the cutting blades according to the invention.

The cutting-blade carrier 10 holds a plurality of cutting blades 11 arranged next to one another and at a distance from one another. The cutting blades 11 are of a type which is known per se, and are produced from an elongate thin strip of a metal of suitable quality. The design of the cutting blades 11 can be seen in particular in FIGS. 8 and 9. Each cutting blade 11 has two substantially planar sides 12 and, for cutting the bread, a cutting edge 13 which has cutting formations. The cutting formations are preferably scallops 14 situated at a regular distance from one another, with cutting points 15 between them.

The cutting-blade carrier 10 according to the invention has a top bar 17 and a bottom bar 18 which is substantially parallel thereto, which bars are designed for attaching the cutting blades 11 between them. The top bar 17 and the bottom bar 18 are connected to one another by means of special spacer means so as to form a unit which can be handled as a single entity. These spacer means are designed in such a way that the top bar 17 and the bottom bar 18 can be moved apart, so as to tension the cutting blades 11, by means of tensioning means 400 which belong to the device 1 and are to be described in more detail below. The spacer means in this example comprise two side supports 19, 20, which are fixed to the bottom bar 18 on either side of the cutting blades 11 and each project in a sideable manner through an associated opening in the top bar 17. A sleeve 21, in which a spring is accommodated (not shown), is arranged on the top bar 17 at the position of each opening in the top bar 17, which sleeve is supported on the associated side support 19, 20. As a result, when the cutting blades 11 are placed between the top bar 17 and the bottom bar 18, a slight preloading of the springs in the sleeves 21 presses the top bar 17 away from the bottom bar 18, so that the cutting blades 11 are held with a slight axial tension in the cutting-blade carrier 10.

In a variant which is not shown, top bar 17 and the bottom bar 18 may be connected by means of spacer means made of elastically extendable material, for example plastic, which extend easily when the top bar 17 and the bottom bar 18 are moved away from one another.

In another variant which is not shown, it may be provided for the spacer means between the top bar 17 and the bottom bar 18 to form a rigid connection per se, but to be removable, so that after the cutting-blade carrier has been placed in the device but before the cutting blades 11 are tensioned the spacer means are removed. The spacer means may if appropriate be removed automatically.

In order to attach the cutting blades 11, the top bar 17 and the bottom bar 18 are each alternately provided with fixed attachment members 22 and adjustable attachment members 23.

The fixed attachment members 22 are suitable hook members, in which a projection, in particular a cylindrical log 26, arranged at the end of the cutting blade 11 can engage. The adjustable attachment members 23, one of which can be seen in FIG. 4, each comprise a sliding body 24, which projects through a corresponding opening in the associated top bar 17 or bottom bar 18. At the end facing towards the cutting blade 11, the sliding body 24 is provided with a suitable hook member 25, in which a projection 26, in particular a cylindrical log, arranged at the end of the cutting blade 11 can engage. On that side of the associated top bar 17 or bottom bar 18 which faces away from the cutting blade 11, a compression spring 27 is placed around the sliding body 24. One end of the compression spring 27 bears against the associated top bar 17 or bottom bar 18, and the other end of the compression spring bears against an adjustment nut 28 which is screwed onto the sliding body 24. By rotating the nut 28, the prestress of the associated spring 27 can be adjusted.

Due to the fact that the fixed and adjustable attachment members 22 and 23 are arranged alternately, it is possible for there only to be a small distance between the cutting blades 11. The possibility of positioning the cutting blades 11 close together is important in particular since the device shown here has only one cutting-blade carrier 10.

Furthermore, the cutting-blade carrier 10 also comprises a handling member 29, which is fixed to the bottom bar 18 and projects in a displaceable manner through an opening in the top bar 17. The handling member 29 can be used as a handle, but may also serve as an engagement point for an automatic exchange device, which is still to be described in more detail, for the cutting-blade carrier 10.

The drive means for the cutting-blade carrier 10 comprise top holding means for holding the top bar 17 of the cutting-blade carrier 10 and bottom holding means for holding the bottom bar 18 of the cutting-blade carrier 10.

In this example, the top holding means comprise an elongate top holding member 30 and the bottom holding means comprise an elongate bottom holding member 31. The two holding members 30, 31 are made from an aluminium extruded section and each have a groove 32, 33, extending in their longitudinal direction, with a slide-in opening at one end of the holding member in question 30, 31, in this example on the side of the magazine and exchange device 3 in FIGS. 1*a*–1*d*. The grooves 32, 33 are open on the side facing towards the other holding member 30, 31, so that the top bar 17 of the cutting-blade carrier 10 can be slid into the top holding member 30 and the bottom bar 18 of the cutting-blade carrier 10 can be slid into the bottom holding member 31, laterally with respect to the passage path for the loaves 7, i.e. from the magazine and exchange device 3, which is still to be explained in more detail.

A strip-like electrical switch 37 (see FIG. 4) is provided in each of the holding members 30, 31 so as to detect the breakage of a cutting blade 11, which switch 37 extends over all the ends of the sliding bodies 24. When a cutting blade 11 breaks, the spring 27 presses the associated sliding body 24 against the switch 37, with the result that the conductive strips in the switch 37 electrically contact one another. This contact preferably leads automatically to the device 1 being shut down.

The device 1 is provided with tensioning means 400 (shown in FIG. 2) to change the distance between the top holding member 30 and the bottom holding member 31, so that after the top bar 17 and the bottom bar 18 of the cutting-blade carrier 10 have respectively been slid into the top and bottom holding members 30, 31, the distance between the top holding member 30 and the bottom holding member 31 can be increased, in order to produce an axial tensile stress, which is referred to as the operational tension, in the cutting blades 11, the level of which tension is equivalent to that which is required to keep each cutting blade 11 in a stable position during the cutting operation. The axial operational tension in each cutting blade 11 is preferably approximately 500 N.

Figure 12:
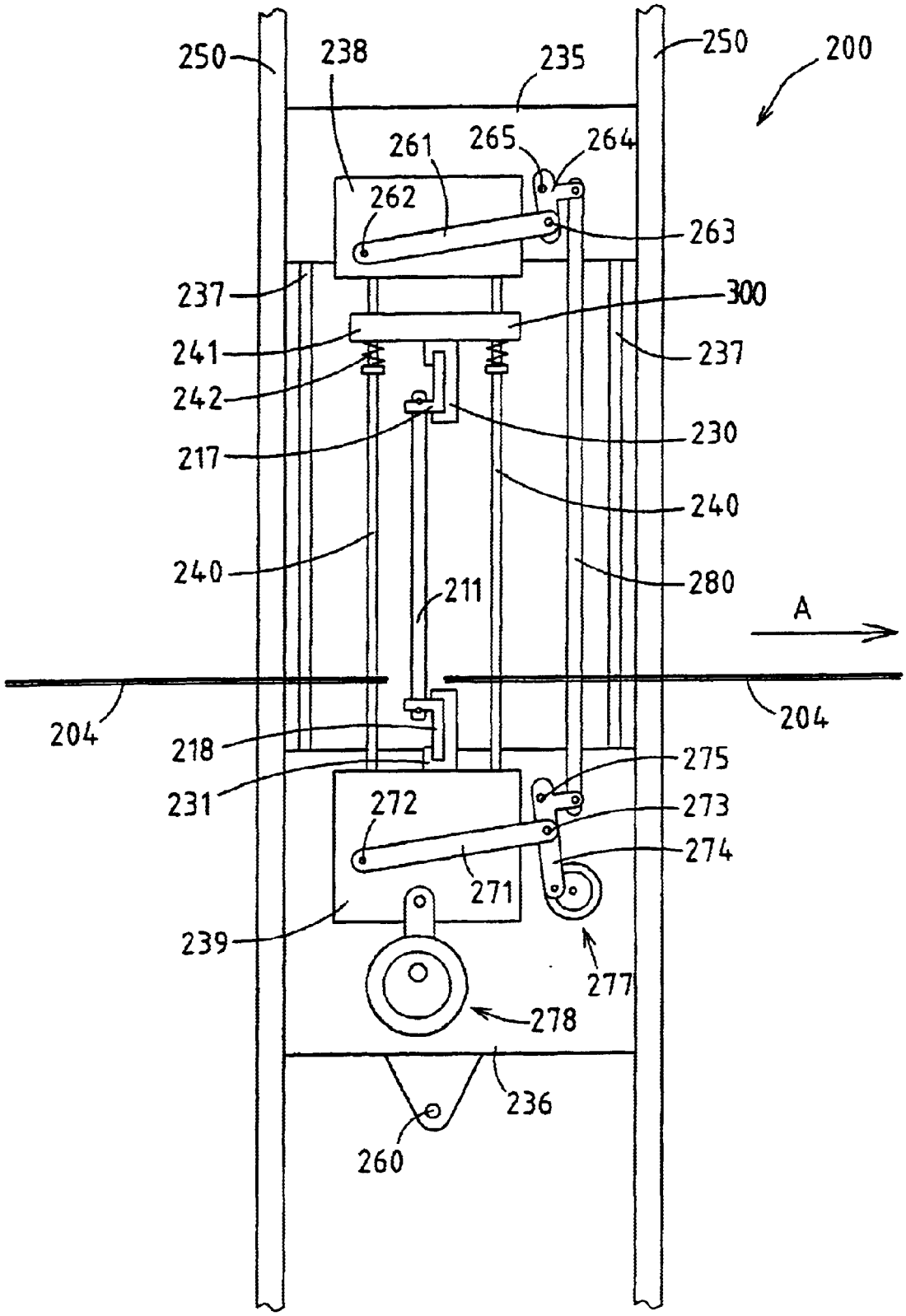

The tensioning means 400 may be designed in a suitable way, for example with hydraulic cylinders which press the top holding member 30 away from the bottom holding member 31. In a preferred embodiment, the tensioning means 400 comprise strong compression springs which support the ends of one of the two holding members 30, 31 and press the holding member in question away from the other holding member. In order to enable a cutting-blade carrier 10 to be removed and placed in position, actuable compression means are provided in order to compress these springs temporarily. This embodiment is shown in FIG. 12.

A first preferred embodiment of the drive means which create the movement of the cutting blades 11 will now be explained with reference to FIG. 2.

The device 1 has a moveable framework 35, which is disposed substantially vertically, with a side bar on either side of the path for the loaves 7, only one side bar being visible in FIG. 2. In the region of its ends, the bottom holding member 31 is fixed to the side bars of the framework 35. The top holding member 30 is guided displaceably in the side bars of the framework 35, so that the distance between the bottom holding member 31 and the top holding member 30 can be adjusted.

The frame 2 of the device 1 comprises straight guides 40, which are disposed substantially vertically, i.e. perpendicular to the path for the loaves, on either side of the path for the loaves 7. A top sliding block 41 and a bottom sliding block 42 are guided displaceably in the straight guides 40. The top sliding block 41 and the bottom sliding block 42 are connected rigidly to one another by means of rods (not shown) which are situated on either side of the path for the loaves.

A pivoting member 44 is attached to the top sliding block 41 so as to pivot about a horizontal pivot pin 43. At a distance from the pivot pin 43, the pivoting member 44 is attached to the top side of the framework 35, so as to pivot about a horizontal pivot pin 45. A spring 46, which counteracts any movement of the pivoting member 44 out of the position shown, is arranged between the pivoting member 44 and the top sliding block 41.

To provide the movement of the cutting blades 11, drive means are provided, which drive the framework 35 which forms a single unit with the cutting blades 11 which have been placed under operational tension.

The drive means comprise a first electric drive motor 51 with a rotating shaft 52 and a disc 53 which is attached to the shaft 52, which drive motor 51 is fixed to the frame 2. A drive rod 54 is attached to the disc 53, eccentrically with respect to the shaft 52. The other end of the drive rod 54 is attached to a lever arm 56 such that it can pivot about pivot point 55. At a distance from the pivot point 55, the lever arm 56 is attached about pivot point 57 to a pivoting member 58. The pivoting member 58 is connected to an actuator 61, with which the pivoting member 58 can be moved with respect to the frame 2, so that the pivot point 57 can be moved from the position shown into position 59.

At a distance from the pivot point 55, the lever arm 56 is attached pivotably about pivot point 60 to the bottom sliding block 42, if appropriate via an intermediate arm (not shown).

The rotation of the shaft 52 of the drive motor 51 effects a reciprocating movement of the sliding blocks 41 and 42 in the vertical straight guides 40. This movement is referred to here as the "first movement" and is characterized by a first amplitude, as seen in the longitudinal direction of the cutting blades 11, and a first frequency.

The framework 35 is not fixed to the sliding blocks 41 and 42, as is usual in the case of devices according to the prior art.

At the top, the framework 35 is guided movably with respect to the top sliding block 41. Since the pivot point 43 of the pivoting member 44 lies substantially horizontally next to the pivot point 45, the point 45 can actually only execute a vertical movement with respect to the top sliding block 41, which in turn can only slide vertically in the straight guides 40.

A second electric drive motor 65 with a rotating shaft 66 and a disc 67 attached thereto is mounted on the bottom sliding block 42. Via a pin 68, which is situated eccentrically with respect to the shaft 66, the disc 67 is connected to the bottom part of the framework 35.

The rotation of the shaft 66 of the second drive motor 65 effects a circular movement, as seen in the plane of FIG. 2, of that point of the framework 35 which is connected to the pin 68 with respect to the bottom sliding block 42.

Therefore, each point of the assembly comprising framework 35 and the cutting blades 11 executes a loop-like movement with respect to the sliding blocks 41 and 42, which movement is referred to here as the "second movement". This loop movement takes place in a plane which is formed by the longitudinal direction of the cutting blades and the passage direction A of the loaves. In the illustration shown in FIG. 2, the eccentricity of the pin 68 with respect to the shaft 66 is shown in an exaggerated manner, purely to clarify the illustration.

It will be clear that in the embodiment of the drive means shown, each point of the assembly comprising framework 35 and cutting blades 11 which is situated in the region of the underside of the framework 35 executes a substantially circular loop movement, and that this loop movement will acquire an increasingly elliptical loop shape at locations situated further away from the pin 68.

The circular movement of the point where the pin 68 engages on the framework 35 has a component in the longitudinal direction of the cutting blades 11 and a component perpendicular to the longitudinal direction of the cutting blades 11. The component in the longitudinal direction of the cutting blades 11 is characterized by a second amplitude and a second frequency.

With respect to the frame 2 of the device 1, and therefore with respect to the loaf 7 to be cut, the cutting blades 11 execute a movement which results from the superimposition of the first rectilinear, reciprocating movement of the bottom sliding block 42 with respect to the frame 2 and of the second circular movement of the framework 35 with respect to the bottom sliding block 42.

In the device 1, the first amplitude is much greater than the second amplitude, and the first frequency is much lower than the second frequency. Preferably, the second amplitude lies in the order of magnitude of one or several millimeters and the second frequency is several tens of, preferably more than a hundred, reciprocating strokes per second. In a practical embodiment, the eccentricity of the pin 68 with respect to the shaft 66 is approximately one millimeter, and the speed of the shaft 66 is approximately 9000 rpm in the direction of the arrows on the disc 67.

It is advantageous here if each of the cutting blades 11 is provided on the cutting edge 13 with cutting formations situated at regular distances from one another, the distance between adjacent cutting formations lying between 0.5 and 4 millimeters.

As described above, the tensioning means of the device 1 preferably comprise compression springs which are positioned between the top holding member 30 and the bottom holding member 31. In order to position a cutting-blade carrier 10, there is provision for the pivoting member 58 to be moved in such a manner by means of the actuator 61 that the pivot point 57 of the lever arm 56 moves to the position 59. This leads to the assembly comprising the bottom sliding block 42 and the top sliding block 41, and therefore also the framework 35, moving further upwards than during normal operation of the device. By then attaching stops to the device 1 at suitable locations, it is possible to achieve the effect that the top holding member 30, which is supported by the springs, on moving upwards meets these stops and is held back thereby, with the result that the tensioning springs are compressed, for example over a distance of 5 millimeters. In this compressed state, it is easy to slide a cutting-blade carrier 10 into the top and bottom holding members 30, 31. By moving the pivoting member 58 back into the position shown in FIG. 2, the cutting blades 11 of the cutting-blade carrier 10 are then tensioned by the tensioning springs.

The device 1 is preferably designed in such a way that the entire mechanism which is shown in FIG. 2 forms part of a unit which can be detached as a whole from the rest of the device 1 and, after opening the door 6, can be removed, in particular for maintenance work. Also, the device 1 is preferably designed in such a way that the housing of the device 1 forms a compartment which is as far as possible closed, for this unit, and that ventilator means are provided, in order to bring about superatmospheric pressure in the said compartment. Contamination of this unit by crumbs is counteracted very effectively in this way.

The device 1 is furthermore provided with cleaning means for the cutting blades 11, which cleaning means are still to be explained in more detail and remove contaminants, in particular pieces of dough, which adhere to the cutting blades 11 during cutting of the bread. These cleaning means in this case comprise a top scraper member 70 and a bottom scraper member 71, which are respectively disposed above and below the path for the loaves 7 which is defined by feed belt 4 and discharge belt 5. In order to clean the cutting blades 11 efficiently, there is provision for the cutting blades 11 to pass at least one of the two scraper members 70, 71 substantially over their entire length which comes into contact with the loaves 7. This can be achieved by means of a suitable design of the drive means which create the first amplitude of the bottom sliding block 42. In view of the height of loaves and other bakery products which are encountered in practice, the first amplitude is therefore considerably greater than the second amplitude. In practical embodiments, the first amplitude lies in the order of magnitude of a number of centimeters, for example 13 centimeters. Although the first reciprocating movement can advantageously contribute to the cutting action of the cutting blades 11, the first movement is aimed in particular to allow the cutting blades 11 to move past the scraper members 70, 71. The first frequency of the first movement can in this case also be low, and in a practical embodiment the shaft 52 can rotate at approximately 100 rpm.

During operation of the device 1 shown, it can be seen that the actual cutting of the loaf is realized substantially by the movement created by the second drive motor 65, that is to say a small loop-like movement of high frequency. It has been found that adhesion and friction cause bread material bearing against the sides 12 of the cutting blades 11 to attempt to move together with the cutting blades 11. The bread material is to a certain extent elastic, and as a result can move with the cutting blades 11 over a short distance without tearing the bread material. However, if the movement of the cutting blades is relatively great, the bread material tears, resulting in the formation of crumbs. When using the device 1, the formation of crumbs is minimal, because the cutting blades 11 execute a very small loop movement with respect to the bread.

The scraper members 70 and 71 are of substantially identical design. Therefore only the scraper member 70 is shown in FIGS. 6, 6*a*, 7, 8 and 9.

The scraper member 70 has an elongate block-shaped body, which is intended to extend in a manner known per se with its longitudinal direction transverse to the cutting blades 11 in the device 1. The scraper member 70 is provided with a plurality of slot openings 73, each allowing the passage of one of the cutting blades 11. Each slot opening 73 is delimited by two walls 74, 75, which lie transverse to the longitudinal direction of the scraper member 70. The walls 74, 75 form a scraper surface 77, 78 on each side of the cutting blade 11, which surface is intended to scrape along the adjacent side of the cutting blade 11 and thus to remove the contaminants from the cutting blade 11. The scraper surfaces 77 and 78 are obtained here by means of the two parts of the walls 74 and 75 which are situated close together and have a smaller dimension than the cutting blade 11 itself, as seen in the direction of the largest cross-sectional dimension of the cutting blade 11. For example, the distance between the scraper surfaces 77 and 78 is 0.9 millimeter for a cutting-blade 11 thickness of 0.5 millimeter. Preferably, the scraper members 70, 71 are made from pearlitic cast iron.

Figure 6A:
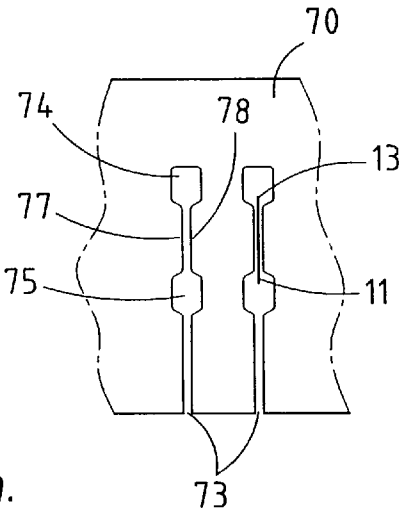
FIG. 6*a* shows part of the view in accordance with FIG. 6 on an enlarged scale.

In the region of the cutting edge 13 and the rear edge of the cutting blade, the walls 74 and 75 are at a greater distance from one another, with the result that, as can be seen in FIG. 6*a*, the cutting edge 13 and the rear edge of the cutting blade 11 appear to lie free of the scraper surfaces 77 and 78. However, as described above, the cutting blade 11 executes a loop-like movement, with the result that virtually the whole of the sides 12 of the cutting blade 11 move past the scraper surfaces 77 and 78.

Figure 7:
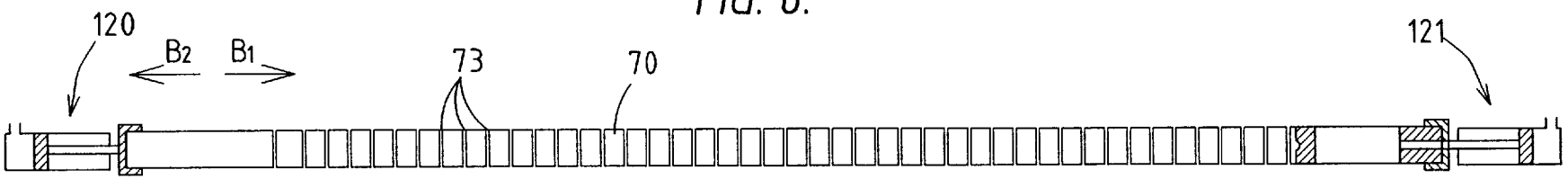
FIG. 7 shows a rear view of the scraper member in accordance with FIG. 6.

For each of the scraper members 70, 71, the device 1 is provided with displacement means which are illustrated diagrammatically in FIG. 7 and enable each scraper member 70, 71 to move in a reciprocating manner in its longitudinal direction with respect to the cutting blades 11, as indicated diagrammatically in FIG. 7 by arrows B1 and B2. In this example, the displacement means comprise two pneumatic cylinders 120, 121, which each engage on one axial end of the scraper member 70 and can press it towards the other axial end. By supplying compressed air to the cylinder 121, the scraper member 70 is pressed in the direction of arrow B1, and the scraper surfaces 78 are applied to the sides 12 of the cutting blades 11, while the scraper surfaces 77 move away from the cutting blades 11. By supplying compressed air to cylinder 120, the scraper member 70 moves in the direction of arrow B2, and the inverse effect is achieved. By moving the scraper members 70, 71 to and fro during operation of the device 1 in the manner described, firstly the cutting blades 11 are cleaned very efficiently, and also the service life of the scraper members 70, 71 is very high, due to the fact that the inevitable wear to the scraper surfaces 77 and 78 of the scraper member 70 is compensated by the reciprocating movement. Preferably, the pressure with which the displacement means press the scraper surfaces 77, 78 against the cutting blades 11 is adjustable. Due to the fact that the scraper surfaces 77 and 78 lie towards the inside with respect to the remainder of the walls 74 and 75, wear is prevented from producing recesses in the walls 74 and 75. This is because this would prevent replacement of the cutting blades, since in that case the new cutting blades have to fit precisely into the worn-down recesses, an effect which in practice is scarcely possible to achieve.

In order to avoid the contaminants scraped off the cutting blades 11 accumulating in the slot openings 73, air channels 80 are arranged in each of the scraper members 70, 71, which channels have an outlet port 81 at each of the slot openings 73, in particular opposite the cutting edge 13 of the cutting blade 11. In the exemplary embodiment shown in FIGS. 8 and 9, an associated air channel 80 is provided for each slot opening 73, which air channel in each case has an inlet port 82 on a side of the scraper member 70 which is situated remote from the slot opening 73. In order to supply air to the inlet ports 82 of the scraper members 70, 71, the device 1 is provided with a top air-injection member 90 and a bottom air-injection member 91, which are of substantially identical design and the top air-injection member 90 of which can be seen in FIGS. 8 and 9. Each of the air-injection members 90, 91 is arranged in such a manner in the device 1 that it extends past the scraper member 70, 71. In particular, it is envisaged that the air-injection members 90, 91 should not be moveable in a reciprocating manner like the scraper members 70, 71.

The air-injection member 90 has a plurality of air-blowing outlets 93, in each case opposite an inlet port 82 of the scraper member 70. Owing to the ability of the scraper member 70 to move in a reciprocating manner with respect to the air-injection member 90, the inlet ports 82 are larger than the air-blowing outlets 93. The air-blowing outlets 93 adjoin a common air channel 94, which is connected to an air compressor (not shown). In this way, compressed air can be introduced into the slot openings 73, with the result that contaminants which have been scraped off are blown away.

Furthermore, it is envisaged that the air supplied to the slot openings 73 can be mixed with a lubricant. To this end, the air-injection members 90, 91 are each provided with a channel 96 for supplying a small quantity of liquid, edible lubricant, and the channel 96 is connected, in each case via a branch channel 97, to the air-branch channel which leads to the air-blowing outlet 93.

Figure 9:
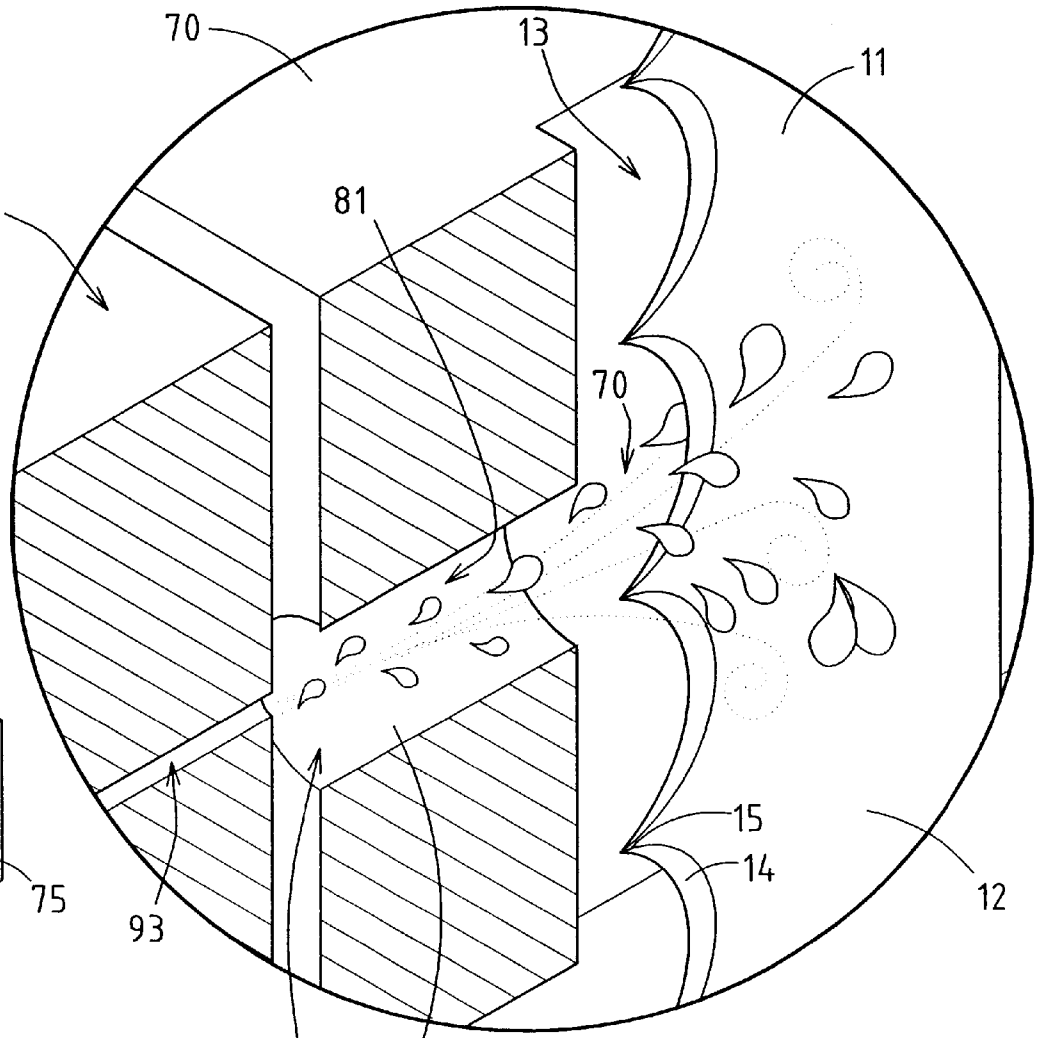
FIG. 9 shows a detail of FIG. 8 on an enlarged scale.

In order to assist the effect of the air supplied to a slot opening 73, optionally mixed with lubricant, a special design of the walls 74 and 75 is provided, as illustrated in particular in FIG. 9. The walls 74, 75 are each provided with a recess, which forms a cavity 98 between the wall in question and the cutting blade 11, which cavity adjoins the outlet port 81 on one side. In particular, the recess is designed in such a way that the passage opening of the cavity 98 decreases in the direction away from the outlet port 81, an effect which in this case is realized by the fact that the recess has the form of a cone. This design of the walls 74, 75 results in a considerable cleaning effect and causes the lubricant to be distributed well over the surface of the cutting blades 11.

Furthermore, it is envisaged that the scraper members 70, 71 can be replaced at the same time as the cutting-blade carrier 10, specifically in an automatic manner. This is made possible by temporarily attaching the scraper members 70, 71 to the cutting-blade carrier 10 in advance, for example by inserting the side supports 19, 20 of the cutting-blade carrier 10 through holes in the ends of the scraper members 70, 71 and providing a clamping member, which holds the scraper member in question in a lightly clamped manner, at suitable locations. In this case, the device 1 is provided with a scraper member handling mechanism for each scraper member, which mechanism is of suitable design, is not shown here and, after the cutting-blade carrier 10 has been placed in the device, grips the associated scraper member 70, 71, and then uncouples the clamping member and moves the scraper member to the desired level with respect to the path for the loaves. Preferably, the scraper member handling mechanisms are designed in such a way that the scraper members are again fixed temporarily to the cutting-blade carrier 10 before the cutting-blade carrier 10 is removed from the device 1, so that the two scraper members 70, 71 are removed together with the cutting-blade carrier 10. It will be clear that the scraper member handling mechanism interacts with the displacement mechanism which effects the axial reciprocating movement of the scraper member for the purpose of cleaning the cutting blades 11.

Figure 10:
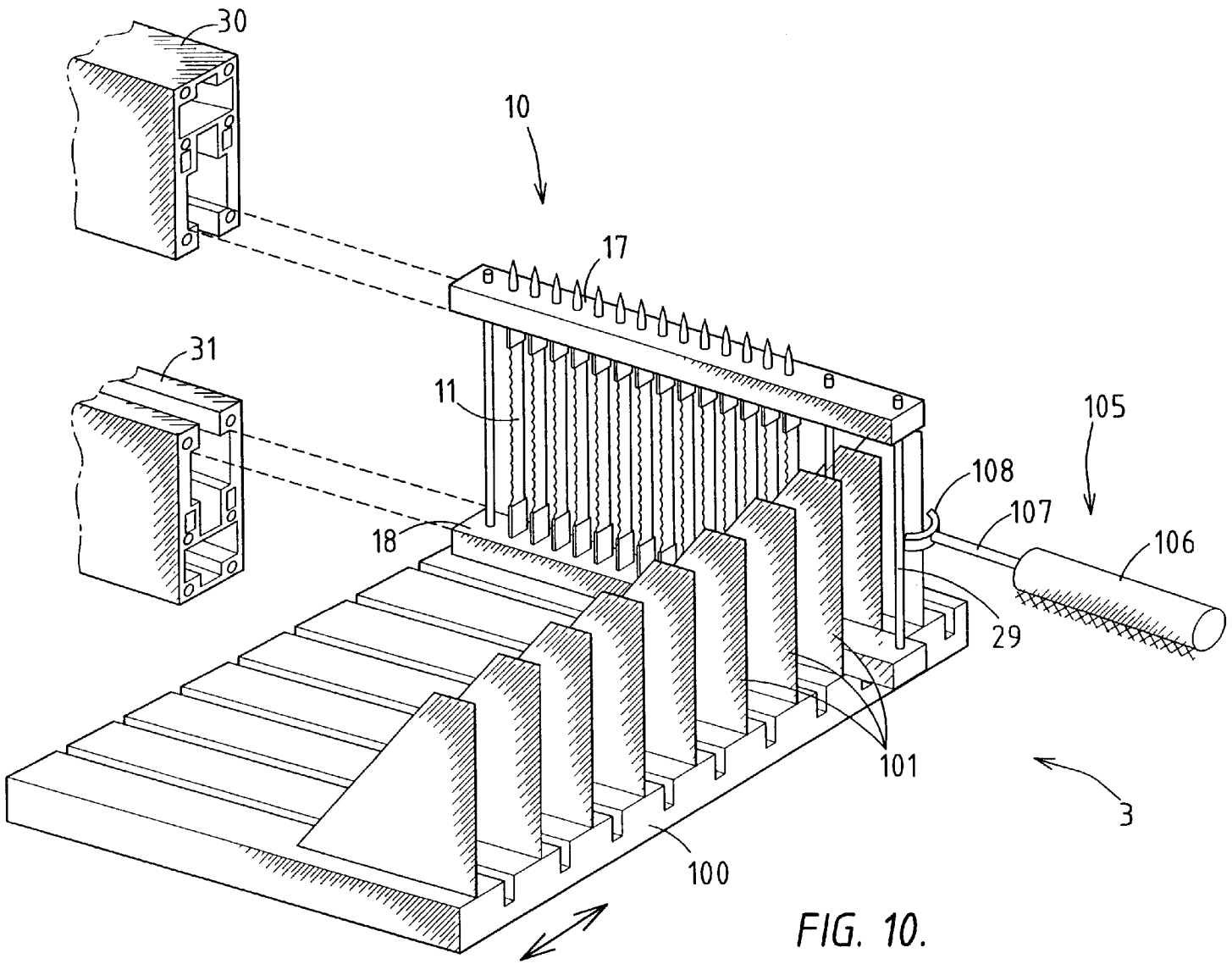
FIG. 10 shows a diagrammatic, perspective view of the magazine and exchanging device of the device according to the invention, FIG. 11 diagrammatically shows part of a cutting blade and the preferred form of the second movement thereof with respect to the support means for the loaves and the passage direction of the loaves, and FIG. 12 diagrammatically shows, in a view in accordance with FIG. 2, part of a device according to the invention, with which the form of the second movement shown in FIG. 11 can be realized.

FIG. 10 diagrammatically shows a preferred embodiment of the magazine and exchange device 3 of the device according to the invention. The magazine and exchange device 3 is intended to hold a stock of a plurality of cutting-blade carriers 10 and to automatically place a cutting-blade carrier 10 in the device 1 and remove it therefrom. In principle, the magazine and exchange device 3 is designed just like slide projectors which are generally known, with the slides replaced by cutting-blade carriers 10. FIG. 10 diagrammatically shows the top holding member 30 and the bottom holding member 31. The magazine and exchange device 3 comprises a carriage 100 with upright supports 101 at a distance from one another, in which case one cutting-blade carrier 10 can be placed between each pair of supports 101. The carriage 100 can be displaced by means of drive means (not shown), in such a manner that a cutting-blade carrier 10 can always be moved into line with the top holding member 30 and the bottom holding member 31. A displacement mechanism 105 is provided near the holding members 30 and 31, in order to displace the cutting-blade carrier 10 present at that location sideways. In this example, the displacement mechanism 105 comprises an actuator 106 with a push-rod 107 and a clamp 108 at the end of the push-rod 107. The clamp 108 is designed to grip the handling member 29 of the cutting-blade carrier 10 and can thus push the cutting-blade carrier 10 into the holding members 30 and 31 or remove it from the holding members 30, 31 and place it in the carriage 100. Using the magazine and exchange device 3 described, a cutting-blade carrier 10 can be exchanged in a very short time, for example 20 seconds.

Figure 11:
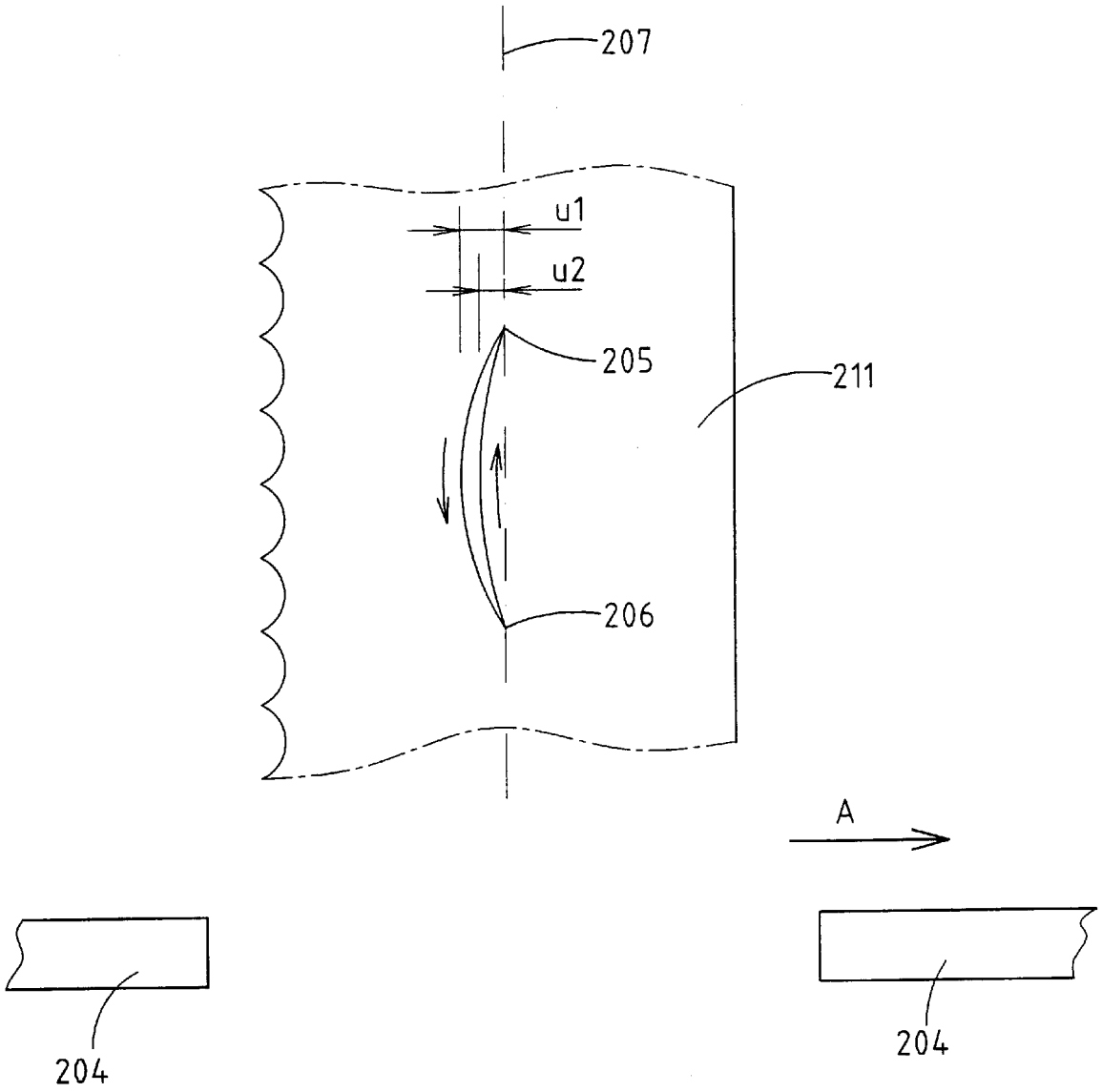

FIG. 11 diagrammatically shows part of a cutting blade 211 of a device according to the invention which is not shown in further detail. Support means 204 for loaves to be cut are also shown diagrammatically, as is the passage direction for the loaves to be cut (arrow A). Furthermore, this FIG. 11 illustrates the preferred embodiment of the small loop-like path of the cutting blade 211, which was referred to in the preceding text as the "second movement", with respect to the support means 204 for the loaves and the passage direction of the loaves.

This loop-like movement describes an arc-like path part, from a top point 205 situated furthest away from the support means 204 towards a bottom point 206 situated closest to the support means 204, with a first deviation U1 with respect to the imaginary straight line 207 between the top point 205 and the bottom point 206. This first deviation U1 is directed counter to the passage direction A. Furthermore, the loop-like movement also describes an arc-like path part from the bottom point 206 to the top point 205, with a second deviation U2 with respect to the imaginary straight line 207 between the bottom point 206 and the top point 205. This second deviation U2 is likewise directed counter to the passage direction A. It can be seen that the first deviation U1 counter to the passage direction A, that is to say the deviation during the downwards stroke of the cutting blade 204, is greater than the second deviation U2 during the upwards stroke. It has been found that such a "half-moon shape" of the second, loop-like movement of the cutting blades is very advantageous for the quality and speed with which the loaves can be cut. If the device according to the invention is equipped with two cutting-blade carriers with cutting blades situated between them, it is preferable for these two cutting-blade carriers to be driven in opposite phase, at least with regard to their second movement, so that the inertia forces of the two cutting-blade carriers in the passage direction partially compensate for one another.

In a view in accordance with FIG. 2, FIG. 12 diagrammatically shows part of a device 200 according to the invention, with which the half-moon shape of the second movement of the cutting blades 211 shown in FIG. 11 can be realized.

FIG. 12 shows part of the feed and discharge belts 204 for the loaves, which belts support the loaves and move them onwards in the passage direction, arrow A. The cutting blades 211 are held in a cutting-blade carrier with a top bar 217 and a bottom bar 218. This top bar 217 and the bottom bar 218 can be moved apart from one another, by means of tensioning means 300 to be described in more detail below, in order to tension the cutting blades 211.

The drive means for the cutting-blade carrier comprise top holding member 230 for holding the top bar 217 and bottom holding member 231 for holding the bottom bar 218, which holding members 230, 231 each have a slide-in groove for sliding in the cutting-blade carrier.

The device 200 has a moveable first framework, which is disposed substantially vertically, with a top bar 235 and a bottom bar 236, which are fixedly connected by means of connecting rods 237 situated on either side of the path for the loaves.

Furthermore, the device 200 has a second framework, which is disposed substantially vertically and can move with respect to the first framework, with a vertical side element on each side of the path for the loaves, which side element is composed of a top block 238 and a bottom block 239, which are fixedly connected to one another by means of two parallel rods 240.

At its ends, the bottom holding member 231 is fixed to the bottom head blocks 239. At each of its ends, the top holding member 230 is arranged on a sliding block 241, which is guided displaceably on the rods 240. Two compression springs 242 are placed in the region of each sliding block 241, which springs 242 are supported against a fixed point of the rods 240 and bear against the bottom of the sliding block 241, thus pressing the sliding block 241 away from the bottom end block 239. These compression springs 242, which have a large spring constant, deliver the tensioning force for tensioning the cutting blades 211. Means (not shown) are provided for pressing the sliding blocks 241 slightly downwards, counter to the force of the springs 242, in order in this way to remove the tensioning from the cutting blades 211 and to be able to remove the cutting-blade carrier from the holding members 230 and 231 or in order to be able to slide the carrier into these holding members.

The frame, which is to be placed on the ground, of the device 200 comprises straight guides 250, which are disposed substantially vertically, i.e. perpendicular to the path for the loaves, on either side of the path for the loaves. The first frame, together with the top first bar 235 and the bottom first bar 236, is guided in the straight guides 250.

First drive means, which are not shown and are designed, for example, as described with reference to FIG. 2, are provided in order to drive the first framework with a first, vertical reciprocating movement. These first drive means engage, for example, on drive point 260. As mentioned earlier, the first movement has a large vertical first amplitude and a low first frequency. Preferably, the first amplitude is sufficient to move the cutting blades 211 past cleaning means which are not shown here.

In order to create the second movement shown in FIG. 11, the second framework is coupled to the first framework in a special way. For this purpose, a pivot arm 261 is arranged on each bottom block 238, one end of which arm can pivot with respect to the said block 238 about a pivot pin 262. The pivot arms 261 point substantially in the passage direction of the loaves. At the other end, each pivot arm 261 is connected pivotably about a pivot pin 263 to an associated tilting arm 264. Each tilting arm 264 is pivotably connected about pivot pin 265, which lies at a distance from pivot pin 263, to the top bar 235 of the first framework. Each bottom block 239 is connected in the same way to the bottom bar 236 of the first framework, by means of a pivot arm 271, which can pivot about pivot pin 272 and is directed parallel to pivot arm 261. At the other end, each pivot arm 271 is connected pivotably, at pivot pin 273, to a tilting arm 274. Each tilting arm 274 is connected pivotably about pivot pin 275, which lies at a distance from pivot pin 273, to the bottom bar 236 of the first framework.

A common tilting-arm drive 277, which forms part of the second drive means of the device 200, is provided for the two bottom tilting arms 274, so as to effect a periodic tilting of the tilting arms 274 about their pivot pin 275. This tilting-arm drive 277 may, for example, comprise a suitable cam disk, as illustrated diagrammatically in FIG. 12. This tilting movement of a bottom tilting arm 274 is transmitted via a rod 280 to the adjacent top tilting arm 264.

Furthermore, an eccentric drive 278, which is positioned between the first framework and the second framework, is provided as another component of the second drive means. The eccentric drive 278 drives both bottom blocks 239 of the second framework.

If the tilting-arm drive 277 is inactive, it will be clear that the second framework, with the cutting blades 211 therein, will move through a path which is described by part of a circle both during the upwards part, that is to say the part moving away from the belts 204, of the second movement and during the downwards part of the second movement, both with a deviation with respect to the vertical which is directed counter to the passage direction A. By then driving the second framework with the aid of the tilting-arm drive 277, which effects a suitable periodic tilting of the tilting arms 264 and 274, the effect is achieved that the deviation in the downwards part of the second movement of the cutting blades 211 with respect to the vertical is greater than in the upwards part, as explained with reference to FIG. 11.

In a variant (not shown) of the device 200 in FIG. 12, there is a third framework next to the second framework, with a second cutting-blade carrier with cutting blades in the third framework. In this case, the third framework is structurally substantially identical to the above-described second framework, including the coupling to the first framework. As a result, the second and third frameworks are driven with the same first vertical reciprocating movement. Furthermore, the cutting blades of the two cutting-blade carriers lie alternately between one another.

In this case, the second and third frameworks are preferably driven in opposite phase by means of the second drive means, so that inertia forces are compensated for as far as possible. It is possible in a simple manner to use this eccentric drive 278 for driving the second and third frameworks in opposite phase. Furthermore, in this variant it is conceivable for the tilting movements of the tilting arms to be derived from the relative movement of the second and third frameworks. Preferably, the second drive means are designed in such a way that the second amplitude lies in the order of magnitude of one or several millimeters and the second frequency is several tens of, preferably more than a hundred, reciprocating strokes per second.

What is claimed is:

1. Device (1) for slicing loaves and other bakery products, comprising a frame (2), the frame (2) having a support means (4, 5) for supporting the loaves (7), the support means defining a path for the loaves through the device, a cutting-blade carrier (10), which holds a plurality of thin, elongate cutting blades (11) next to one another and at a distance from one another, each cutting blade having a cutting edge (13) which has cutting formations for cutting the loaves, the cutting-blade carrier comprising a top attachment body (17) which is common to the cutting blades and a bottom attachment body (18) which is common to the cutting blades, wherein one end of each cutting blade is connected to the bottom attachment body and the other end of each cutting blade is connected to the top attachment body, the top attachment body (17) and the bottom attachment body (18) are connected to one and another by a spacer means forming a unit which is handled as a single entity, wherein the spacer means (19, 20) allow the top attachment body (17) and the bottom attachment body(18) to move apart and to tension the cutting blades (11) with an axial operating tension for cutting the loaves, a tensioning means for providing an axial operational tension for each cutting blade (11) during a cutting operation, a drive means for creating a reciprocating movement of the cutting blades with respect to the support means for the loaves, the reciprocating movement being parallel to the longitudinal direction of the cutting blades, wherein the top attachment body (17) and the bottom attachment body (18) of the cutting-blade carrier (10) are displaceable with respect to one another, wherein the drive means are provided with top holding means (30) for releasably holding the top attachment body (17) of the cutting-blade carrier and with bottom holding means (31) for releasably holding the bottom attachment body (18) of the cutting-blade carrier, and further wherein the tensioning means provide the axial operational tension by changing the distance between the top holding means (30) and the bottom holding means (31), so that after the top and bottom attachment bodies have been arranged in the top and bottom holding means, respectively, the distance between the top and bottom holding means is increased to provide an axial operational tensioning of the cutting blades (11).

2. Device according to claim 1, wherein the top holding means and the bottom holding means each comprise an elongate holding member extending transversely to the passage direction, each holding member having a groove (32, 33) extending in its longitudinal direction, with a slide-in opening at one end of the holding member, which groove (32, 33) is open on the side facing towards the other holding member, so that the attachment bodies (17, 18) of the cutting-blade carrier (10) is slid into the holding members (30, 31).

3. Device according to claim 1, wherein the cutting-blade carrier (10) comprises two side supports (19, 20) on either side of the cutting blades (11), the side supports being fixedly connected to one of the top or bottom attachment bodies and being in communication with the other attachment body, whereby one attachment body is moveable in the direction away from the other attachment body.

4. Device according to claim 1 further including cleaning means for the cutting blades for cleaning the cutting blades during cutting of the loaves, the cleaning means being disposed outside the path for the loaves which is defined by the support means, the cleaning means comprising a scraper member, which extends transversely to the cutting blades, and a plurality of slot openings, each for the passage of a cutting blade, wherein means are provided for releasably attaching the scraper member to the cutting-blade carrier (10), so that the scraper member, together with the cutting-blade carrier, is handled as a unit, and further wherein the device is provided with support means for the scraper member, the support means gripping the scraper member, which is attached to the cutting-blade carrier and together with the cutting-blade carrier is placed in the device, and to hold the carrier fixedly with respect to the cutting blades which move during the cutting operation.

5. Device according to claim 1, wherein the top attachment body (17) or the bottom attachment body (18) is provided with a fixed attachment member (22), and the other attachment body is provided with an adjustable attachment member (23) having an attachment point (25) which is moveable substantially in the longitudinal direction of the cutting blade (11), and further wherein the fixed attachment member (22) and the adjustable attachment member (23) are arranged alternately on the top attachment body (17) and the bottom attachment body (18).

6. Device according to claim 1, wherein the device is provided with a magazine device (100, 101) for holding a stock of a plurality of cutting-blade carriers (10), and further wherein an exchange device (105) is provided in order to automatically remove a cutting-blade carrier from the magazine device and couple it to the drive means (30, 31) and to uncouple the cutting-blade carrier from the drive means and place the uncoupled cutting-blade carrier in the magazine device.

7. Device according to claim 6, wherein the magazine device comprises a displaceable carriage (100), the carriage forming a holding space for each cutting-blade carrier (10), wherein the holding space extends transversely to a displacement direction of the carriage.

* * * * *